US010796671B2

(12) United States Patent
Ichiki

(10) Patent No.: US 10,796,671 B2
(45) Date of Patent: Oct. 6, 2020

(54) KEYBOARD APPARATUS

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/131,106

(22) Filed: Sep. 14, 2018

(65) Prior Publication Data

US 2019/0012992 A1 Jan. 10, 2019

Related U.S. Application Data

(63) Continuation of application No. PCT/JP2017/011425, filed on Mar. 22, 2017.

(30) Foreign Application Priority Data

Mar. 25, 2016 (JP) ..... 2016-061666

(51) Int. Cl.

| | |
|---|---|
| ***G10C 3/12*** | (2006.01) |
| ***G10H 1/34*** | (2006.01) |
| ***G10B 3/12*** | (2006.01) |
| ***G10C 3/04*** | (2006.01) |

(52) U.S. Cl.

CPC ..... *G10C 3/12* (2013.01); *G10B 3/12* (2013.01); *G10C 3/04* (2013.01); *G10H 1/34* (2013.01)

(58) Field of Classification Search

CPC ..... G10C 3/12; G10C 3/04

See application file for complete search history.

(56) References Cited

U.S. PATENT DOCUMENTS 7,208,668 B2 * 4/2007 Shimoda ..... G10C 3/12 84/434
7,732,686 B2 * 6/2010 Yamaguchi ..... G10H 1/346 84/236
7,750,222 B2 * 7/2010 Osuga ..... G10C 3/12 84/423 R (Continued)

FOREIGN PATENT DOCUMENTS

JP H04289895 A 10/1992
JP 2000099028 A 4/2000

(Continued)

OTHER PUBLICATIONS

International Search Report issued in Intl. Appln. No. PCT/JP2017/011425 dated Jun. 6, 2017. English translation provided.

(Continued)

*Primary Examiner* — Robert W Horn
(74) *Attorney, Agent, or Firm* — Rossi, Kimms & McDowell LLP

(57) ABSTRACT

A keyboard apparatus includes a key; a guide regulating a direction in which the key moves, the guide being arranged at three or more locations not lined in a straight line when seen along a scale direction of the key, and the guide slidably making contact with the key from the scale direction; and a connecting portion connecting the key to a frame at the back side of the key from the guide, the connecting portion including a rod-like flexible member.

18 Claims, 11 Drawing Sheets

(56) References Cited

U.S. PATENT DOCUMENTS

| | | | | |
|---|---|---|---|---|
| 7,767,892 | B2 * | 8/2010 | Osuga | G10C 3/12 84/423 R |
| 7,807,912 | B2 * | 10/2010 | Tsumeishi | G10C 3/12 84/433 |
| 7,952,010 | B2 * | 5/2011 | Minakawa | G10C 3/125 84/423 R |
| 8,076,563 | B2 * | 12/2011 | Kamimura | G10C 3/12 84/423 R |
| 8,110,732 | B2 * | 2/2012 | Shimoda | G10C 3/12 84/423 R |
| 8,258,389 | B2 * | 9/2012 | Suzuki | G10C 3/12 84/423 R |
| 8,766,075 | B2 * | 7/2014 | Ishida | G10H 1/34 84/423 R |
| 8,969,698 | B1 * | 3/2015 | Suzuki | G10C 3/12 84/436 |
| 9,082,372 | B2 * | 7/2015 | Suzuki | G10C 3/12 |
| 9,177,535 | B2 * | 11/2015 | Suzuki | G10C 3/18 |
| 2006/0021490 | A1 * | 2/2006 | Yamaguchi | G10C 3/12 84/236 |
| 2007/0017341 | A1 | 1/2007 | Nishida | |

FOREIGN PATENT DOCUMENTS

| | | | |
|---|---|---|---|
| JP | 2009236944 | A | 10/2009 |
| JP | 2010008736 | A | 1/2010 |
| JP | 2011221560 | A | 11/2011 |

OTHER PUBLICATIONS

Written Opinion issued in Intl. Appln. No. PCT/JP2017/011425 dated Jun. 6, 2017.

English translation of Written Opinion issued in Intl. Appln. No. PCT/JP2017/011425 dated Jun. 6, 2017, previously cited in IDS filed Sep. 14, 2018.

* cited by examiner

KEYBOARD APPARATUS

CROSS REFERENCE TO RELATED APPLICATIONS

This application is a U.S. continuation application filed under 35 U.S.C. § 111(a), of International Application No. PCT/JP2017/11425, filed on Mar. 22, 2017, which claims priority to Japanese Patent Application No. 2016-061666, filed on Mar. 25, 2016, the disclosures of which are incorporated by reference.

FIELD

The present invention relates to a keyboard apparatus.

BACKGROUND

A keyboard apparatus includes a plurality of keys arranged side by side. An array precision of the plurality of keys greatly influences the aesthetic appearance of a musical instrument. Thus, when the shape of the key deforms by manufacturing error, this leads to degradation in the aesthetic appearance of the musical instrument. A technique for adjusting the position of the key when the manufacturing error occurs thus has been developed (e.g., patent document 1: Japanese Patent Application Laid-Open No. 2010-8736).

SUMMARY

According to an embodiment of the present invention, a keyboard apparatus including a key; a guide regulating a direction in which the key moves, the guide being arranged at three or more locations not lined in a straight line when seen along a scale direction of the key, and the guide slidably making contact with the key from the scale direction; and a connecting portion connecting the key to a frame at the back side of the key from the guide, the connecting portion including a rod-like flexible member is provided.

Furthermore, according to an embodiment of the present invention, a keyboard apparatus including a key; a guide regulating a direction in which the key moves, the guide being arranged at three or more locations not lined in a straight line when seen along a scale direction of the key, and the guide slidably making contact with the key from the scale direction; and a connecting portion connecting the key to a frame at the back side of the key from the guide, the connecting portion including a plate-like flexible member, and a normal direction of the plate-like flexible member including a component in the scale direction is provided.

Furthermore, according to an embodiment of the present invention, a keyboard apparatus including a key; a guide regulating a direction in which the key moves, the guide being arranged at three or more locations not lined in a straight line when seen along a scale direction of the key, and the guide slidably making contact with the key from the scale direction; and a connecting portion connecting the key to a frame at the back side of the key from the guide, the connecting portion including a rotation member and a supporting member with an upper member and a lower member that sandwich the rotating member from a vertical direction, the rotation member or the supporting member having a shape including a circular arc when a cross-section including the scale direction at a portion where the rotation member and the supporting member are brought into contact is seen is provided.

DESCRIPTION OF EMBODIMENTS

Figure 1:
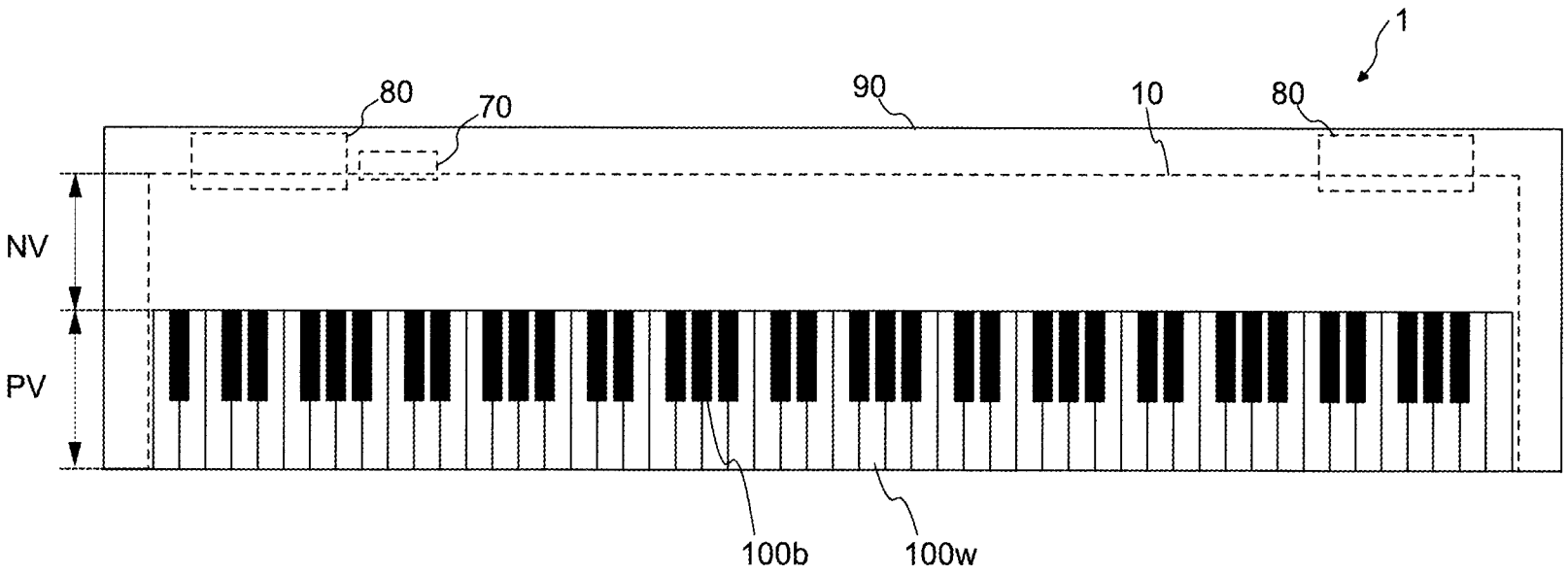
FIG. 1 is a view showing a configuration of a keyboard apparatus according to a first embodiment.

A keyboard apparatus according to one embodiment of the present invention will be hereinafter described in detail with reference to the drawings. The embodiment described below is an example of the embodiment of the present invention, and the present invention should not be interpreted as being limited to such embodiment. In the figures referenced in the present embodiment, the same reference numeral or similar reference numeral (reference numeral simply added with A, B etc. after the number) is denoted on the same portion or the portion having similar function, and redundant description is sometimes omitted. Furthermore, a dimensional ratio (ratio between each configuration, ratio in longitudinal, lateral and height direction, etc.) of the figure may be different from the actual ratio, or one part of the configuration may be omitted from the figure for the sake of convenience of explanation.

In electronic keyboard musical instruments such as an electronic piano, the key is generally supported in a turnable manner by a frame at a back end side of the key (far side seen from a player). An amount that can be pushed on a front end side of the key is designed in accordance with an acoustic piano. The position where the key is supported by the frame, that is, a turning center of the key is on the player's side from a turning center of the key in the acoustic piano.

According to such configuration, the length of the key can be shortened, and the size in a depth direction of the electronic keyboard musical instrument can be reduced. In this case, the feeling at the time of pushing the key changes as the position of the turning center of the key differs between the key of the electronic keyboard musical instrument and the key of the acoustic piano. When the key of the electronic keyboard musical instrument is made long and the turning center of the key is moved toward the far side, the size in the depth direction of the electronic keyboard musical instrument becomes large. Furthermore, the influence of deformation caused by manufacturing error, temporal change, and the like further increases if the key is made long. For example, when the key is bent in a scale direction, the influence of deformation with respect to the scale direction is greater in the long key from in the short key.

One object of the present invention is to reduce the influence of deformation even if the key is deformed.

First Embodiment

[Configuration of Keyboard Apparatus]

FIG. 1 is a view showing a configuration of a keyboard apparatus according to a first embodiment. In this example, a keyboard apparatus 1 is an electronic keyboard musical instrument that outputs a sound in response to the pushing of a key by a user (player) such as an electronic piano. The keyboard apparatus 1 may be a keyboard type controller that outputs control data (e.g., MIDI) for controlling an external sound source device in response to the pushing of the key. In this case, the keyboard apparatus 1 may not include the sound source device.

The keyboard apparatus 1 includes a keyboard assembly 10. The keyboard assembly 10 includes a white key 100*w* and a black key 100*b*. A plurality of white keys 100*w* and a plurality of black keys 100*b* are arrayed side by side. The number of keys 100 is N, and is 88 in this example, but the number of keys is not limited thereto. A direction in which the keys 100 are arrayed is called a scale direction. When a description can be made without particularly distinguishing the white key 100*w* and the black key 100*b*, the white key 100*w* and the black key 100*b* are sometimes referred to as the key 100. In the following description, the configuration with "w" denoted at the end of the reference numeral is the configuration corresponding to the white key. The configuration with "b" denoted at the end of the reference numeral is the configuration corresponding to the black key.

One part of the keyboard assembly 10 exists inside a housing 90. When the keyboard apparatus 1 is seen from above, a portion of the keyboard assembly 10 covered by the housing 90 is referred to as a non-appearing portion NV, and a portion exposed from the housing 90 and visible from the user is referred to as an appearing portion PV. In other words, the appearing portion PV indicates a region constituting one part of the key 100 that can be played and operated by the user. Hereinafter, a portion of the key 100 exposed by the appearing portion PV is sometimes referred to as a key main body portion.

A sound source device 70 and a speaker 80 are arranged inside the housing 90. The sound source device 70 generates a sound waveform signal accompanying the pushing of the key 100. The speaker 80 outputs the sound waveform signal generated by the sound source device 70 to an external space. The keyboard apparatus 1 may include a slider for controlling the volume, a switch for switching the tone, a display for displaying various information, and the like.

In the description of the present specification, directions such as up, down, left, right, near, far, and the like are directions of when the keyboard apparatus 1 is seen from the player when playing. For example, the non-appearing portion NV can be expressed as being located on the far side from the appearing portion PV. The direction may be indicated with the key 100 as the reference such as a key front end side (key front side) and key back end side (key back side). In this case, the key front end side indicates the near side seen from the player with respect to the key 100. The key back end side indicates the far side seen from the player with respect to the key 100. According to the definition described above, in the black key 100*b*, the front end to the back end of the key main body portion of the black key 100*b* can be expressed as being a portion projecting out toward the upper side from the white key 100*w*.

Figure 2:
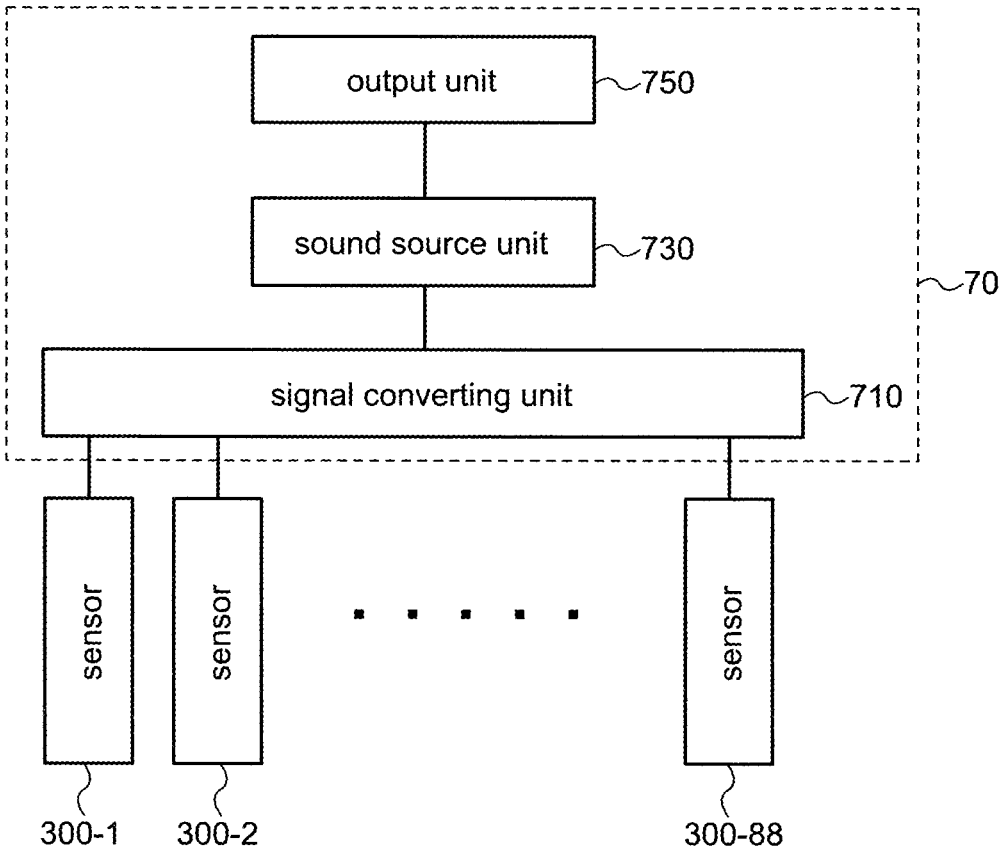
FIG. 2 is a block diagram showing a configuration of a sound source device according to the first embodiment.

FIG. 2 is a block diagram showing a configuration of the sound source device in the first embodiment. The sound source device 70 includes a signal converting unit 710, a sound source unit 730, and an output unit 750. A sensor 300 is arranged in correspondence with each key 100 to detect the operation of the key, and output a signal corresponding to the detected content. In this example, the sensor 300 outputs a signal according to a key-pushing amount of three stages. A key-pushing speed can be detected according to an interval of such signals.

The signal converting unit 710 acquires an output signal of the sensor 300 (sensors 300-1, 300-2, . . . , 300-88 corresponding to 88 keys 100), and generates an operation signal corresponding to an operation state in each key 100, and outputs the operation signal. In this example, the operation signal is a signal of MIDI format. The signal converting unit 710 thus outputs a note-on according to the key-pushing operation. A key number indicating which one of the 88 keys 100 is operated, and a velocity corresponding to the key-pushing speed is output in correspondence with the note-on. The signal converting unit 710 corresponds and outputs the key number and a note-off according to a key releasing operation. A signal corresponding to other operations of a pedal, and the like may be input to the signal converting unit 710, and reflected on the operation signal.

The sound source unit 730 generates the sound waveform signal based on the operation signal output from the signal converting unit 710. The output unit 750 outputs the sound waveform signal generated by the sound source unit 730. The sound waveform signal is, for example, output to the speaker 80, a sound waveform signal output terminal, and the like.

[Configuration of Keyboard Assembly]

Figure 3:
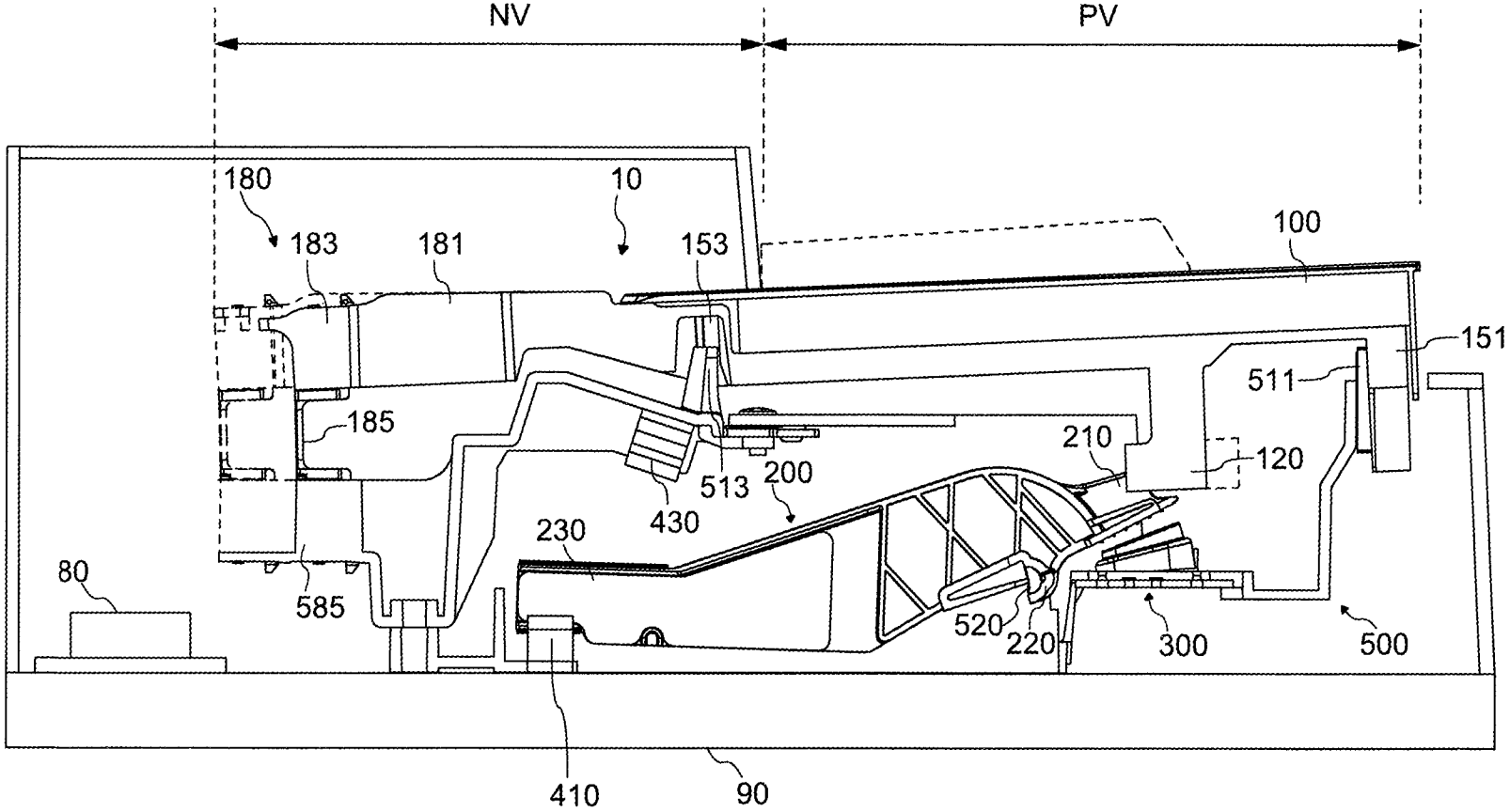
FIG. 3 is an explanatory view of when a configuration inside a housing according to the first embodiment is seen from a side surface.

FIG. 3 is an explanatory view of when the configuration inside the housing according to the first embodiment is seen from a side surface. As shown in FIG. 3, the keyboard assembly 10 and the speaker 80 are arranged inside the housing 90. The speaker 80 is arranged on the far side of the keyboard assembly 10. The speaker 80 is arranged to output the sound corresponding to the pushing of the key toward the upper side and the lower side of the housing 90. The sound output toward the lower side advances toward the outside from the lower surface side of the housing 90. The sound output toward the upper side passes from the inside of the housing 90 through a space inside the keyboard assembly 10, and advances toward the outside from the gap between the adjacent keys 100 in the appearing portion PV or the gap between the key 100 and the housing 90.

The configuration of the keyboard assembly 10 will be described using FIG. 3. In addition to the key 100 described above, the keyboard assembly 10 also includes a connecting portion 180, a hammer assembly 200, and a frame 500. The keyboard assembly 10 is a structural body made of resin in which the majority of the configuration is manufactured by injection molding, and the like. The frame 500 is fixed to the housing 90. The connecting portion 180 turnably connects the key 100 to the frame 500. The connecting portion 180 includes a plate-like flexible member 181, a key side supporting portion 183, and a rod-like flexible member 185. The connecting portion 180 may include a member that moves integrally with the key 100, or may further include a member that moves integrally with the frame 500. The plate-like flexible member 181 is extended from the back end of the key 100. The key side supporting portion 183 is extended from the back end of the plate-like flexible member 181. The rod-like flexible member 185 is supported by the key side supporting portion 183 and a frame side supporting portion 585 of the frame 500. In other words, the rod-like flexible member 185 is arranged between the key 100 and the frame 500. The key 100 can be turned with respect to the frame 500 when the rod-like flexible member 185 is bent. The rod-like flexible member 185 is configured to be detachable from the key side supporting portion 183 and the frame side supporting portion 585. The rod-like flexible member 185 may be integral with at least one of the key side supporting portion 183 or the frame side supporting portion 585, or may be adhered thereto so as not be detachable.

The key 100 includes a front end key guide 151 and a side key guide 153. The front end key guide 151 is slidably brought into contact with a front end frame guide 511 of the frame 500 while covering the front end frame guide 511. The front end key guide 151 is brought into contact with the front end frame guide 511 from both sides in the scale direction, the upper part and the lower part. In other words, the front end key guide 151 is slidably brought into contact with the front end frame guide 511 from the scale direction at two locations, the upper part and the lower part. In the front end key guide 151, the upper part corresponds to an upper key guide 151*u*, and the lower part corresponds to a lower key guide 151*d* (see FIG. 7B). The side key guide 153 is slidably brought into contact with a side frame guide 513 from both sides in the scale direction. In other words, the side key guide 153 is slidably brought into contact with the side frame guide 513 from the scale direction. In this example, the side key guide 153 is arranged in a region corresponding to the non-appearing portion NV of the side surface of the key 100, and exists on the key front end side from the connecting portion 180 (plate-like flexible member 181), but may be arranged in a region corresponding to the appearing portion PV.

The hammer assembly 200 is turnably attached to the frame 500. A shaft supporting portion 220 of the hammer assembly 200 and a shaft 520 of the frame 500 are slidably brought into contact at at least three points. A front end 210 of the hammer assembly 200 is brought into contact with a hammer supporting portion 120 in an internal space of the hammer supporting portion 120 in a manner slidable in essentially a front and back direction. The slidably moving portion, that is, the portion where the front end 210 and the hammer supporting portion 120 are brought into contact is located on the lower side of the key 100 in the appearing portion PV (front side from the back end of the key main body portion).

The hammer assembly 200 includes a weight portion 230 made of metal at a far side from the shaft. At a normal time (when key is not pushed), the weight portion 230 is mounted on a lower stopper 410, and the front end 210 of the hammer assembly 200 is pushing back the key 100. When the key is pushed, the weight portion 230 is moved upward thus hitting an upper stopper 430. The hammer assembly 200 applies a load to the pushing of the key with the weight portion 230. The lower stopper 410 and the upper stopper 430 are formed with a buffer material and the like (non-woven cloth, elastic body, etc.).

The sensor 300 is attached to the frame 500 on the lower side of the hammer supporting portion 120 and the front end 210. The front end 210 deforms the sensor 300 with the lower surface side thereof according to the pushing of the key, and the sensor 300 outputs a detection signal. As described above, the sensor 300 is arranged in correspondence with each key 100.

Figure 4:
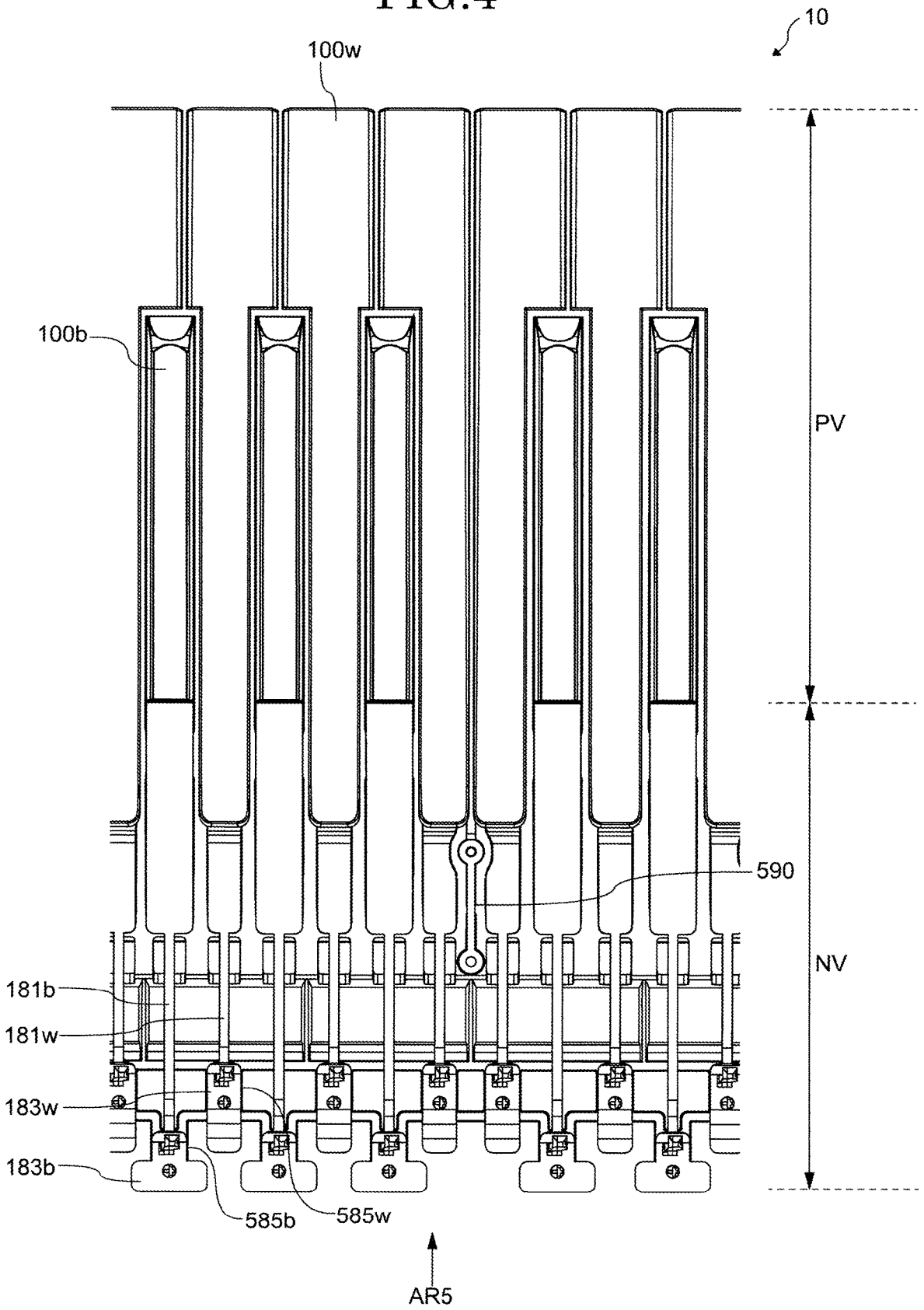
FIG. 4 is an explanatory view of when a keyboard assembly according to the first embodiment is seen from an upper surface.
Figure 5:
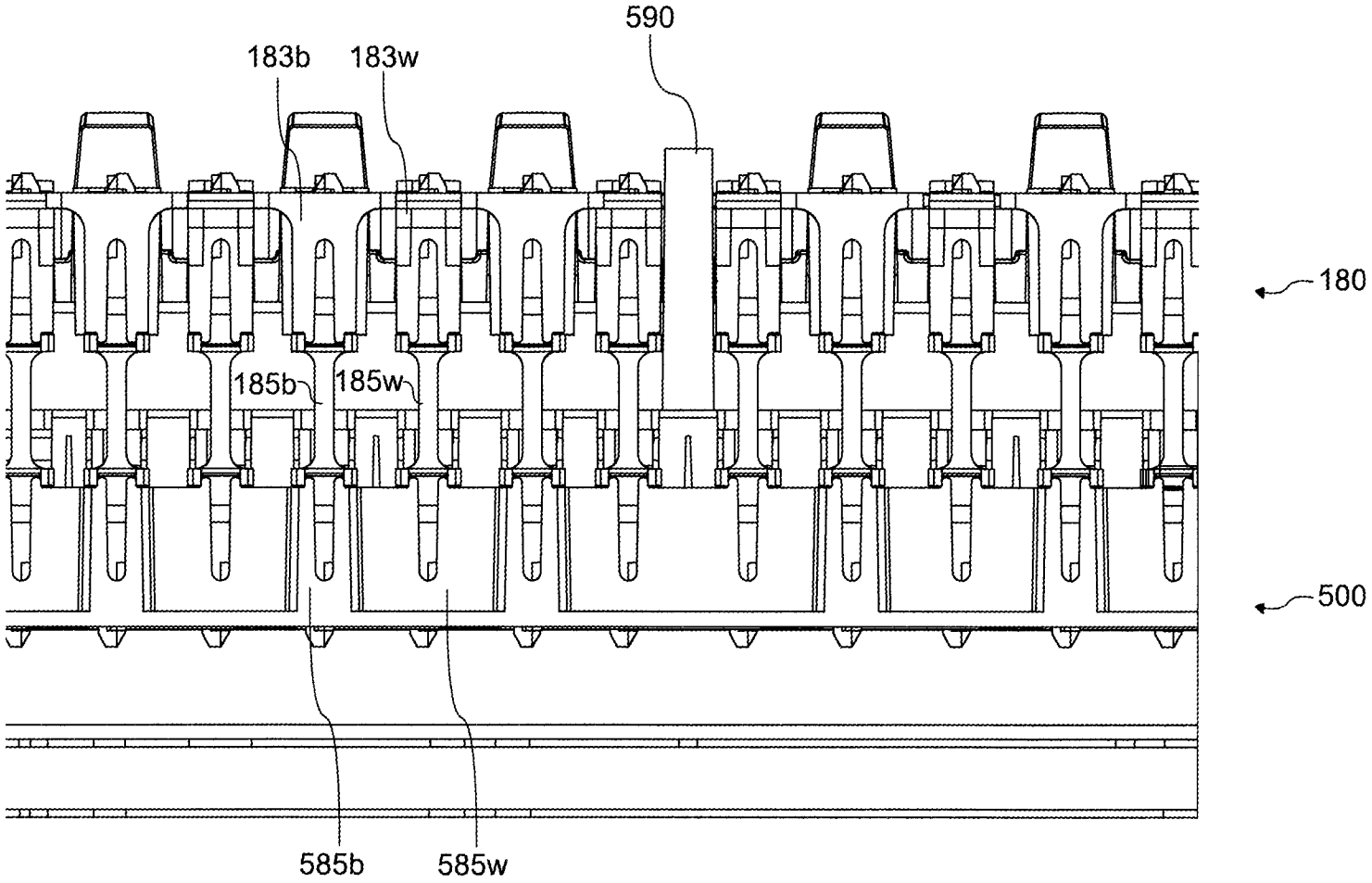
FIG. 5 is an explanatory view of when a frame according to the first embodiment is seen from a far side.
Figure 6:
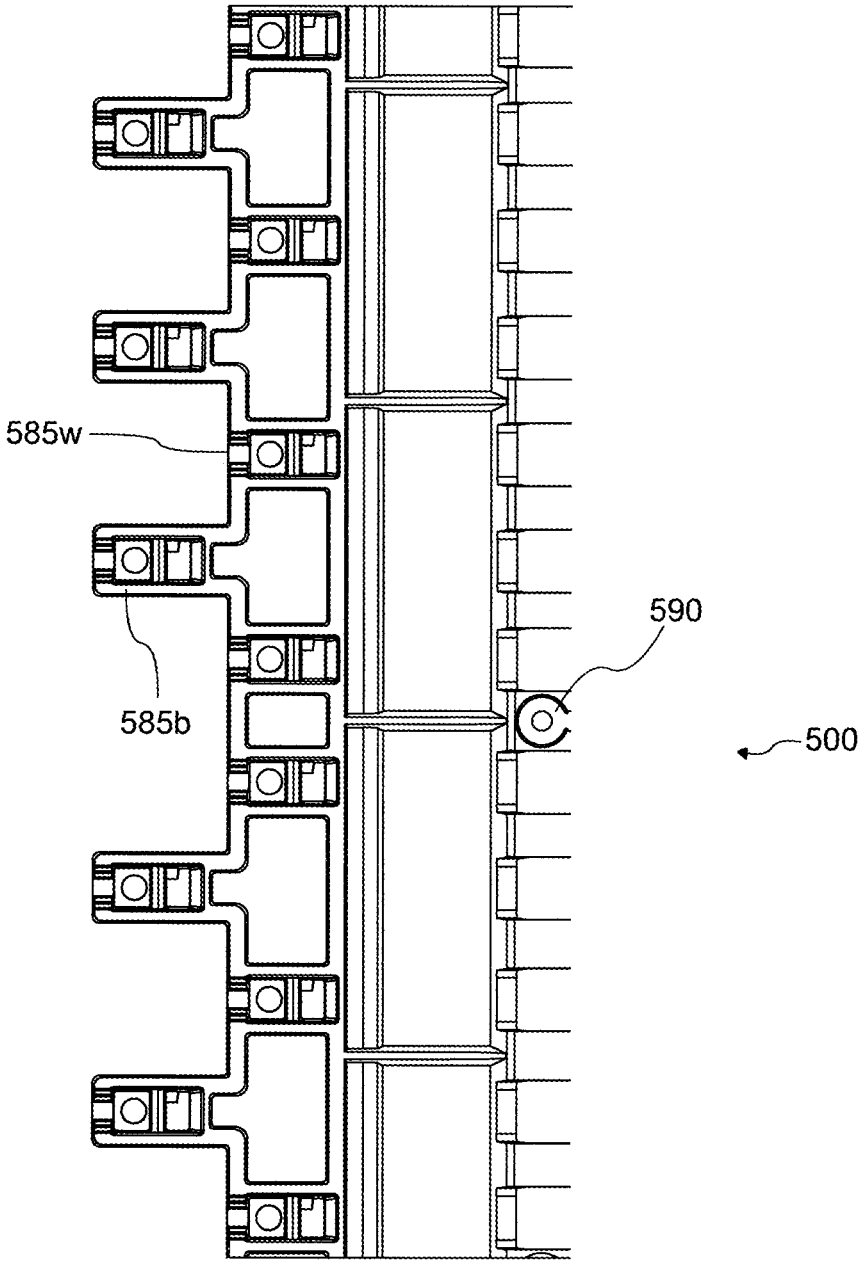
FIG. 6 is an explanatory view of when a portion of the frame where a rod-like flexible member is connected according to the first embodiment is seen from the upper surface.

FIG. 4 is an explanatory view of when the keyboard assembly according to the first embodiment is seen from the upper surface. FIG. 5 is an explanatory view of when the frame according to the first embodiment is seen from the far side (AR5 direction indicated in FIG. 4). FIG. 6 is an explanatory view of when a portion of the frame where the rod-like flexible member is connected according to the first embodiment is seen from the upper surface. In these figures, the illustration of one part of the configurations of the hammer assembly 200 and the frame 500 located on the lower side of the key 100 is omitted. Specifically, the configuration (frame side supporting portion 585, etc.) of the frame 500 in the vicinity of the connecting portion 180 is illustrated, and the illustration of one part of the configuration on the near side, and the like is omitted. In other descriptions as well, the illustration of one part is sometimes omitted.

As shown in FIG. 4, a key side supporting portion 183*b* is arranged on the far side from a key side supporting portion 183*w*. This position is associated with the position of the rod-like flexible member 185 that becomes the turning center of the key 100. The difference in the turning center of the white key and the black key of an acoustic piano can be demonstrated by such arrangement. In this example, a plate-like flexible member 181*b* corresponding to the black key is longer than a plate-like flexible member 181*w* corresponding to the white key. In correspondence with such arrangement, a frame side supporting portion 585*b* of the frame 500 is arranged on the far side from a frame side supporting portion 585*w*. Thus, the shape of the far side (frame side supporting portion 585) of the frame 500 is a shape in which the frame side supporting portion 585*b* is projected out from the frame side supporting portion 585*w*, as shown in FIG. 6.

As shown in FIG. 5, a large space exists between the rod-like flexible members 185*b*, 185*w*. The sound output from the speaker 80 is passed through such space from outside of the keyboard assembly 10 to reach the inside, and released to the outside of the keyboard apparatus 1 from the gap between the adjacent keys 100. As there is only a few elements that shield the passing of the sound between the frame 500 (frame side supporting portion 585) and the connecting portion 180 (key side supporting portion 183) due to the existence of the rod-like flexible member 185 in path until the sound is released to the outside from the appearing portion PV, the attenuation amount of the sound can be suppressed.

A supporting column 590 is a member connected to the housing 90 to fix the position of the frame 500 with respect to the housing 90. The supporting column 590 is arranged between portions where the white keys 100*w* are adjacent in the non-appearing portion NV, that is, between the white key 100*w* of "E" and the white key 100*w* of "F", and between the white key 100*w* of "B" and the white key 100*w* of "C".

[Structure of White Key]

Figure 7A:
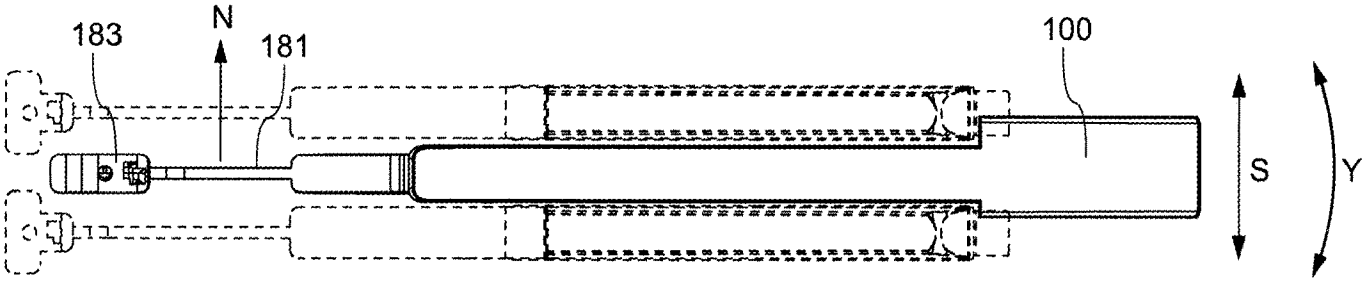
FIGS. 7A to 7D are views describing a detailed structure of a white key in the first embodiment.
Figure 7B:
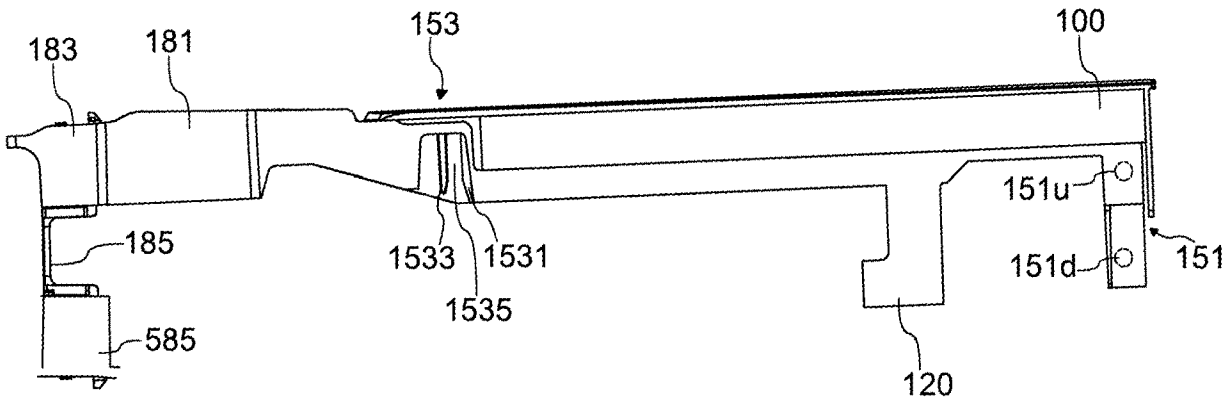
Figure 7C:
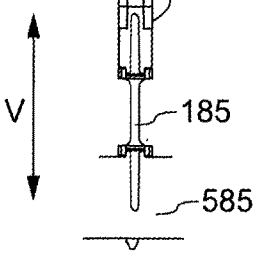
Figure 7D:
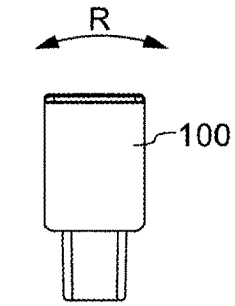

FIGS. 7A to 7D are views describing a detailed structure of a white key in the first embodiment. FIG. 7A is a view of the white key 100*w* seen from the upper surface. FIG. 7B is a view of the white key 100*w* seen from the side surface (left side). FIG. 7C is a view of the connecting portion 180 seen from the far side. FIG. 7D is a view of the white key 100*w* seen from the near side.

First, directions (scale direction S, rolling direction R, yawing direction Y, vertical direction V) used in the following description will be defined. The scale direction S corresponds to a direction (left and right direction seen from the player) in which the keys 100 are arrayed, as described above. The rolling direction R corresponds to a direction of rotating with an extending direction (direction from near side to far side seen from the player) of the key 100 as an axis. The yawing direction Y is a direction of bending in the left and right direction when the key 100 is seen from above. There is no great difference between the scale direction S and the yawing direction Y, but the movement in the scale direction S of the key 100 is a parallel movement whereas the movement in the yawing direction Y of the key 100 corresponds to bending (warping) in the scale direction S. The vertical direction V corresponds to a direction (vertical direction seen from the player) in which the rod-like flexible member 185 is extended, and can also be referred to as a direction that becomes an axis of bending in the yawing direction Y.

The key 100 includes the front end key guide 151 and the side key guide 153. As described above, the front end key guide 151 is brought into contact with the front end frame guide 511 of the frame 500 at the upper part and the lower part. Thus, the front end key guide 151 is actually divided into the upper key guide 151*u* and the lower key guide 151*d*. The front end key guide 151 (upper key guide 151*u*, lower key guide 151*d*) and the side key guide 153 regulate the movement of the key 100 at three locations not lined in a straight line when the key 100 is seen in the scale direction S. The movement of the key 100 is regulated in the scale direction S, the yawing direction Y, and the rolling direction R according to the guide at least three locations arranged in such manner. In this example, the side key guide 153 also regulates the movement in the front and back direction of the key 100 as the side frame guide slidably moves on a groove 1535 formed by projections 1531, 1533. The number of guides may be three or more locations. In this case, not all guides need to satisfy a requirement of not being lined in a straight line, and the guide at at least three locations merely needs to satisfy the requirement.

The plate-like flexible member 181 is a plate-like member having flexibility. The plate-like flexible member 181 is arranged so that a normal direction N of a plate surface is directed in the scale direction S. Thus, the plate-like flexible member 181 can be deformed in the rolling direction R and the yawing direction Y by being bent and twisted. In other words, the plate-like flexible member 181 has a degree of freedom in the rolling direction R and the yawing direction Y of the key 100 due to its flexibility. It can be said that the plate-like flexible member 181 also has a degree of freedom in the scale direction S by combining the deformation in the yawing direction Y. However, the plate-like flexible member 181 barely deforms in the vertical direction. The normal direction N may not completely coincide with the scale direction S. and merely needs to have a component in the scale direction S. If the normal direction does not coincide with the scale direction, an angle formed by the normal direction N and the scale direction S is preferably as small as possible.

The rod-like flexible member 185 is a rod-like member having flexibility. The rod-like flexible member 185 can be deformed in the rolling direction R and the yawing direction Y by being bent and twisted. In other words, the rod-like flexible member 185 has a degree of freedom in the rolling direction R and the yawing direction Y of the key 100 due to its flexibility. It can be said that the rod-like flexible member 185 also has a degree of freedom in the scale direction S by combining the deformation in the rolling direction R. However, the rod-like flexible member 185 barely deforms in the vertical direction. The rod-like flexible member 185 has more twistable amount than the plate-like flexible member 181 due its shape property.

A cross-sectional shape (cross-section perpendicular to rod-like extending direction (corresponds to longitudinal direction in a case of a rod shape lying along a straight line)) of the rod-like flexible member 185 is a shape surrounded by a combination of a curved line and a straight line, and is a semicircular shape in the present example. In a semicircular shape, a straight line portion is on the far side and a curved portion is on the near side, but may be reversed. The cross-sectional shape of the rod-like flexible member 185 may be a shape (e.g., circular shape) surrounded by only curved lines, or may be a shape (e.g., rectangular shape) surrounded by only straight lines. In other words, as long as the rod-like flexible member 185 can be bent deformed in directions (two out of three directions defining three-dimension) other than the longitudinal direction (vertical direction), and can be twist deformed with the longitudinal direction as an axis, the cross-sectional shape may be any shape. The rod-like flexible member 185 may have a shape in which a thickness changes along the longitudinal direction such as a cone shape. Furthermore, when an outer edge of the cross-sectional shape is accommodated in a rectangle, a ratio of a length of two orthogonal sides of the rectangle is desirably greater than or equal to 3/4 and smaller than or equal to 4/3.

Thus, the connecting portion 180 not only turns the key 100 in a pitch direction (turning direction of normal pushing of key) with respect to the frame 500 so that a vertical displacement barely occurs (vertical movement of turning center barely occurs) with respect to a strong force of pushing of the key at a back side of the key (far side) from the side key guide 153, but also allows deformation with respect to the rolling direction R and the yawing direction Y. In other words, the connecting portion 180 not only turns the key 100 with respect to the frame 500, but allows deformation with respect to the rolling direction R and the yawing direction Y. The connecting portion 180 has the movement regulated in the vertical direction, but has a degree of freedom with respect to the rolling direction R and the yawing direction Y of the key 100. As described above, it can be said that the connecting portion 180 also has a degree of freedom in the scale direction S by combining the deformation in the rolling direction R.

As described above, the key 100 sometimes produces deformation including the yawing direction Y and rolling direction R due to manufacturing error and temporal change. In this case, the influence of deformation of the key 100 is prevented from being visibly recognized as much as possible in the appearing portion PV between the front end key guide 151 and the side key guide 153 by the regulation of such guides. As the influence of deformation is suppressed at the appearing portion PV, the non-appearing portion NV is greatly subjected to such influence of deformation. The influence is more significant the longer the key 100.

For example, assume a case in which a deformation (deformation in the rolling direction R) where the key 100 is gradually twisted occurred as a first example. In this case, the direction of the rolling direction R of the front end portion of the key 100 is regulated so as to be in a perpendicular direction by the upper key guide 151*u* and the lower key guide 151*d*, and thus the influence of deformation in the rolling direction R becomes greater toward the far side in the key 100. As a second example, assume a case in which a deformation (deformation in the yawing direction Y)

where the key 100 is gradually bent in the scale direction S occurred. In this case, the position in the scale direction S of the key 100 in the appearing portion PV is regulated by the front end key guide 151 and the side key guide 153, and thus the influence of deformation in the yawing direction Y becomes greater toward the far side in the key 100.

In either case, the positions of the portion that becomes the turning center of the key 100 and the frame 500 start to shift by the influence of deformation of the key 100. In other words, the position relationship of the connecting portion 180 connected to the key 100 and the frame side supporting portion 585 starts to shift.

According to the key 100 of the first embodiment, the plate-like flexible member 181 and the rod-like flexible member 185 can be deformed by flexibility, and the influence of the shift in the positions of the key 100 and the frame side supporting portion 585 can be suppressed by the deformation of the connecting portion 180 (plate-like flexible member 181 and rod-like flexible member 185). At this time, the rod-like flexible member 185 not only has a function of a member for turning the key 100 in the pitch direction as it can be bent deformed in the front and back direction of the key 100 while preventing vertical displacement from barely occurring (vertical movement of the turning center from barely occurring) with respect to a strong force of pushing of the key, but also has a function of a member for absorbing the influence of deformation of the key 100.

As described above, the influence of deformation of the key 100 is suppressed as much as possible from being visibly recognized at the appearing portion PV, and thus the positional precision in the scale direction S is also high. Thus, the front end 210 of the hammer assembly 200 detected by the sensor 300 and the hammer supporting portion 120 of the key 100 connected to the front end 210 are desirably arranged on the lower side of the key 100 of the appearing portion PV (front side from the back end of the key main body portion).

[Comparison of White Key and Black Key]

Figure 8A:
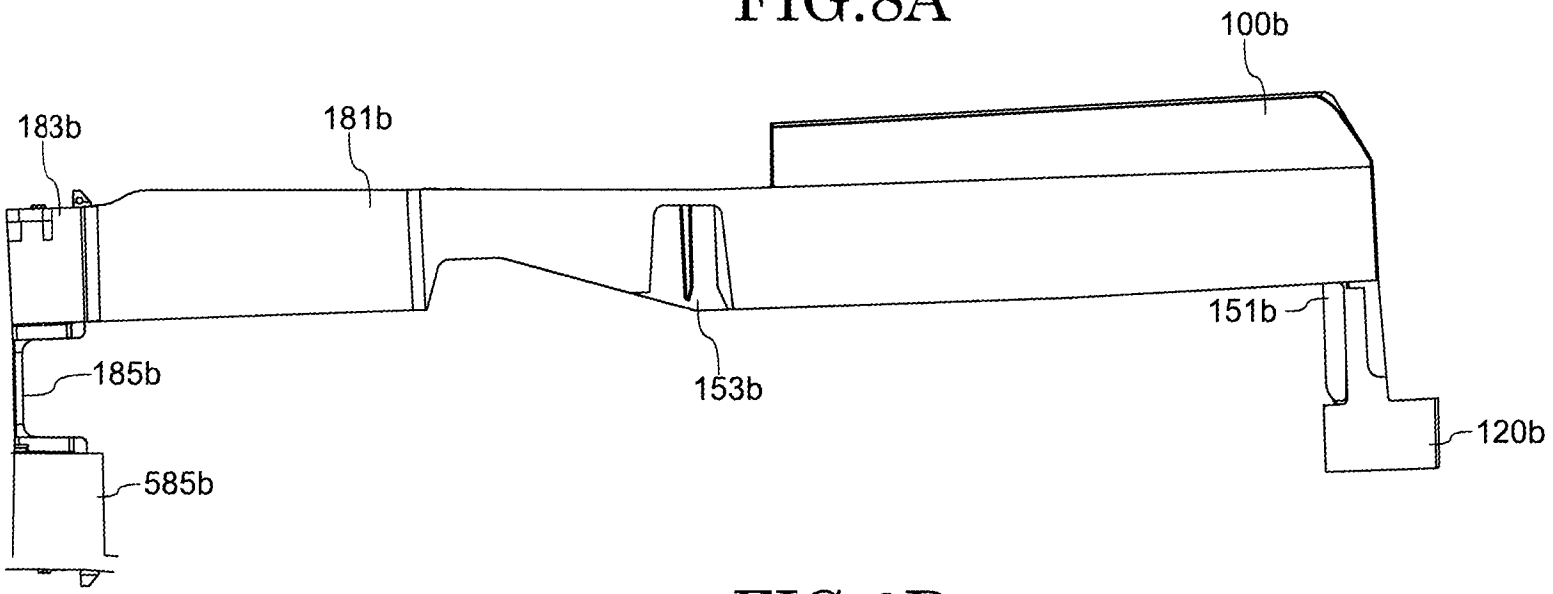
FIGS. 8A and 8B are views describing a structure of a black key in the first embodiment in comparison with the structure of the white key.
Figure 8B:
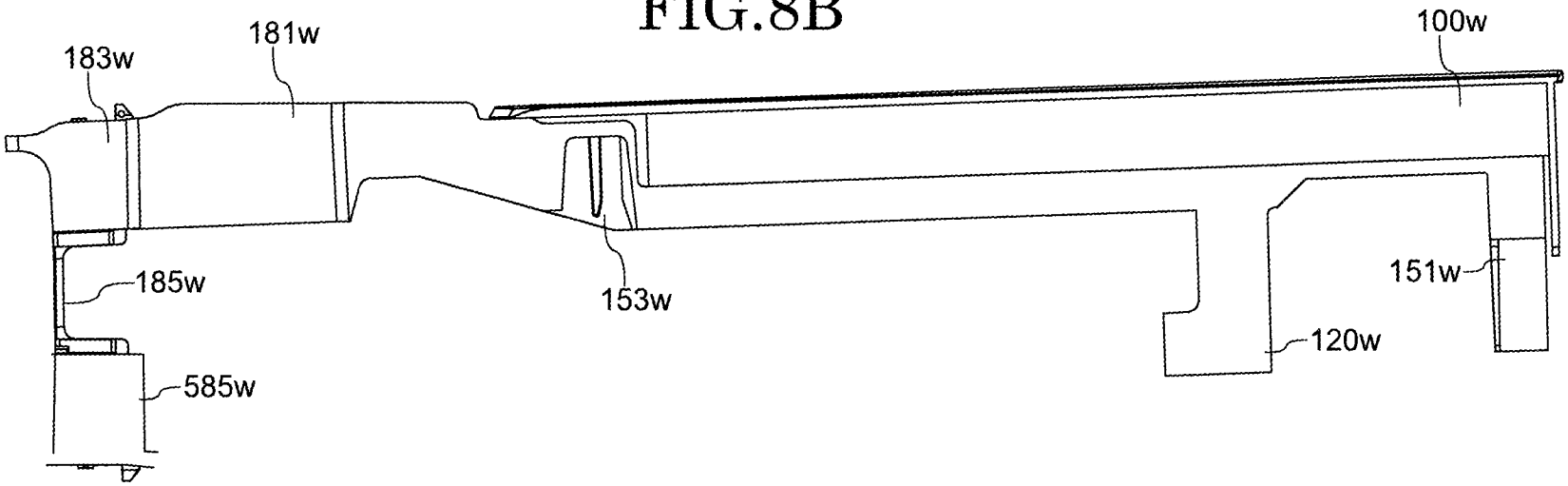

FIGS. 8A and 8B are views describing a structure of a black key in the first embodiment in comparison with the structure of the white key. FIG. 8A shows a black key. FIG. 8B shows a white key. In FIGS. 8A and 8B, the positions in the front and back direction of the white key 100*w* and the black key 100*b* are shown in an associated manner. The white key 100*w* and the black key 100*b* differ in the following points. The plate-like flexible member 181*b* is longer than the plate-like flexible member 181*w*. In this example, the positions of the turning center of the key are differed by such difference, but the positions of the turning center of the key may be differed through other methods. For example, the plate-like flexible member 181*b* and the plate-like flexible member 181*w* may have the same length, and the length other than the plate-like flexible member 181*b* of the black key 100*b* may be lengthened.

In the white key 100*w*, the front end key guide 151*w* is arranged at a different location with respect to the key front and back direction from the hammer supporting portion 120*w*. In the black key 100*b*, on the other hand, the front end key guide 151*b* and the hammer supporting portion 120*b* are arranged at substantially the same location in the key front and back direction. In other words, in the black key 100*b*, the hammer supporting portion 120*b* is arranged at a front end portion of the black key 100*b*. That is, the hammer supporting portion 120*w* of the white key 100*w* is arranged in accordance with the position of the hammer supporting portion 120*b* of the black key 100*b*.

[Operation of Keyboard Assembly]

Figure 9A:
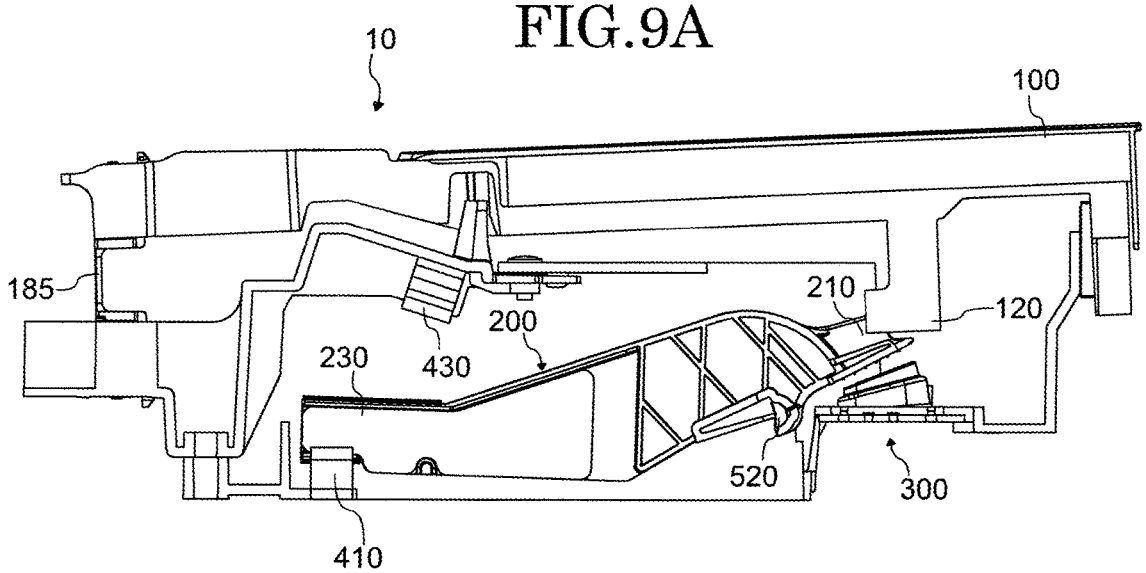
FIGS. 9A and 9B are views describing an operation of the key assembly of when the key (white key) is pushed in the first embodiment.
Figure 9B:
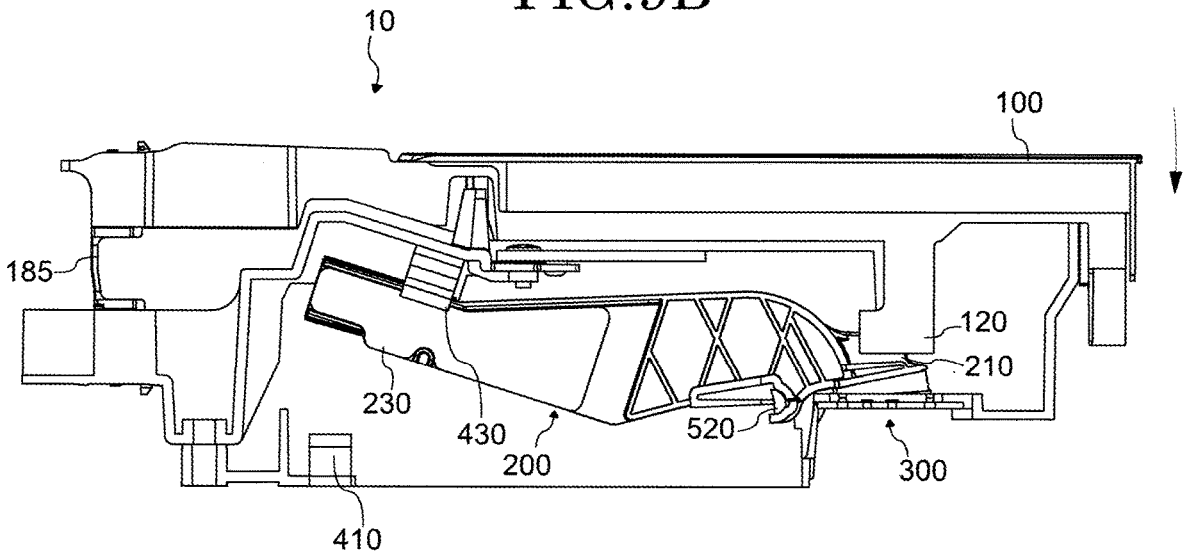

FIGS. 9A and 9B are views describing an operation of the key assembly of when the key (white key) is pushed in the first embodiment. FIG. 9A is a view of when the key 100 is at a rest position (state in which the key is not pushed). FIG. 9B is a view of when the key 100 is at an end position (state in which the key is pushed to the end). When the key 100 is pushed, the key is bent with the rod-like flexible member 185 as the turning center. In this case, the rod-like flexible member 185 is bent deformed toward the front side (near side direction) of the key, but the key 100 is turned in the pitch direction rather than being moved forward by the regulation of the movement in the front and back direction by the side key guide 153. As the hammer supporting portion 120 pushes down the front end 210, the hammer assembly 200 turns with the shaft 520 as the center. The turning of the hammer assembly 200 stops when the weight portion 230 hits the upper stopper 430, whereby the key 100 reaches the end position. Furthermore, when the sensor 300 is deformed by the front end 210, the sensor 300 outputs a detection signal at a plurality of stages corresponding to the deformed amount (key pushing amount).

When the key is released, the weight portion 230 is moved toward the lower side, the hammer assembly 200 is turned, and the key 100 is turned toward the upper side. The turning of the hammer assembly 200 is stopped when the weight portion 230 is brought into contact with the lower stopper 410, and the key 100 is returned to the rest position.

The keyboard apparatus 1 of the first embodiment has the key 100 connected to be turnable by the pushing of the key and the releasing of the key at the connecting portion 180, as described above. The keyboard apparatus 1 can reduce the influence of deformation caused by the manufacturing error and the temporal change of the key 100 on the appearing portion PV by the regulation of the movement by the front end key guide 151 and the side key guide 153 and the deformation of the connecting portion 180.

Second Embodiment

In a second embodiment, a connecting portion 180A having a configuration different from the connecting portion 180 in the first embodiment will be described.

Figure 10A:
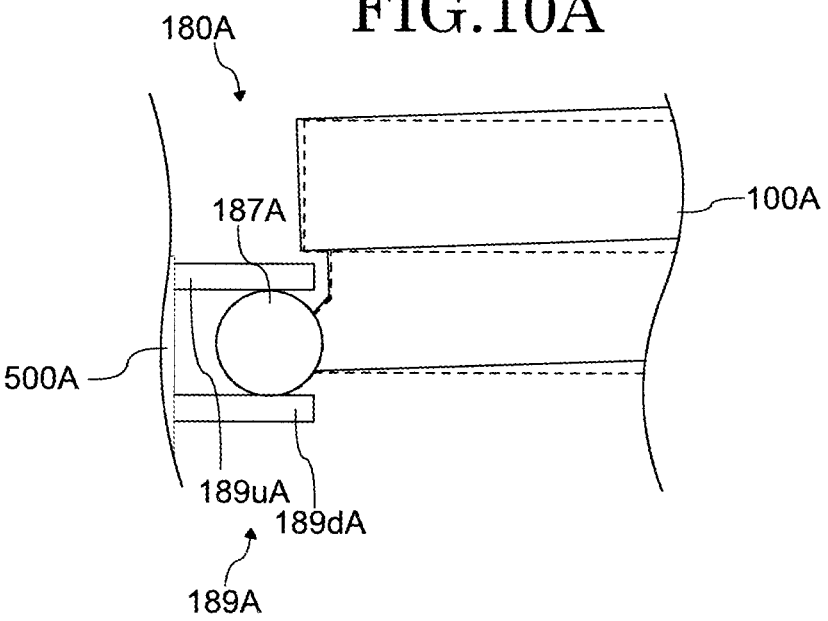
FIGS. 10A to 10D are views describing a structure of a connecting portion according to a second embodiment.

FIGS. 10A to 10D are views describing a structure of the connecting portion according to a second embodiment. FIG. 10A is a view of the connecting portion 180A seen from a side direction, and is a view describing a position by pushing and releasing of a key 100A. As shown in FIG. 10A, a solid line indicates a case in which the key 100A is at a rest position and a broken line indicates a case in which the key 100A is at an end position. The connecting portion 180A includes a rotation member 187A and a supporting member 189A. The supporting member 189A includes an upper member 189*u*A and a lower member 189*d*A. The rotation member 187A is a spherical body in this example, and is connected to the key 100A. The supporting member 189A is fixed to a frame 500A, and the top and bottom of the rotation member 187A are sandwiched by plate-shaped upper member 189*u*A and lower member 189*d*A extending in the scale direction.

Figure 10B:
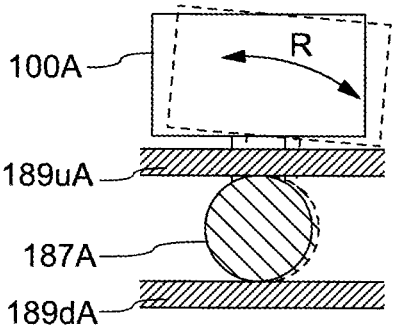
Figure 10C:
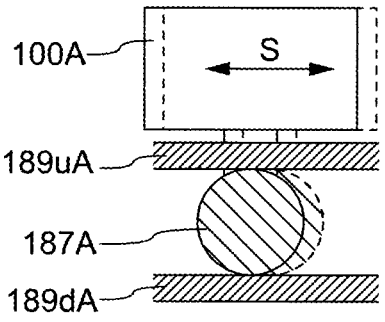
Figure 10D:
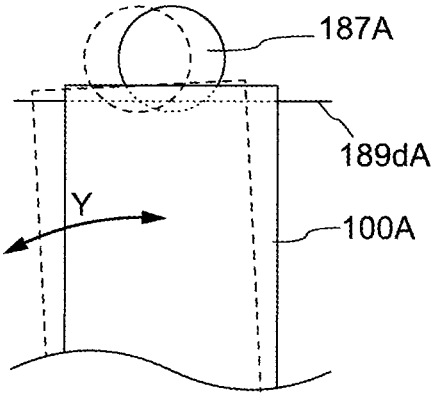

FIGS. 10B and 10C are views, seen from the far side, of a cross-section including the scale direction of the connecting portion 180A at a portion where the rotation member 187A and the supporting member 189A are brought into contact. FIG. 10B shows an example of when the key 100A is moved in the rolling direction R. FIG. 10C shows an example of when the key 100A is moved in the scale direction S. FIG. 10D is a view of the connecting portion 180A seen from above, and shows an example of when the key 100A is moved in the yawing direction Y. In FIG. 10D, the illustration of the upper member 189*u*A is omitted.

The rotation member 187A can be slidably moved to carry out parallel movement and rotational movement between the upper member 189*u*A and the lower member 189*d*A. As shown in FIGS. 10B to 10D, the rotation member 187 is movable in the scale direction S, the yawing direction Y, and the rolling direction R. In other words, the connecting portion 180A has the movement regulated in the vertical direction but has a degree of freedom with respect to the scale direction S, the rolling direction R, and the yawing direction Y of the key 100A.

The shape of the rotation member 187A is not limited to a spherical body. The rotation member 187A merely needs to include a circular arc when the cross-section including the scale direction is seen at the portion where the rotation member 187A and the supporting member 189A are brought into contact. Furthermore, as long as the rotation member 187A can be rotated, the supporting member 189A side can include the circular arc. A point contact is carried out at the portion where the rotation member 187A and the supporting member 189A are brought into contact, but a line contact may be carried out when seen in the cross-sectional shape in the front and back direction of the key.

The rotation member 187A and the supporting member 189A may be reversed. In other words, the rotation member 187A may be connected to the frame 500A and the supporting member 189A may be connected to the key 100A.

Third Embodiment

In a third embodiment, a connecting portion 180B having a configuration different from the connecting portion 180 in the first embodiment will be described.

Figure 11:
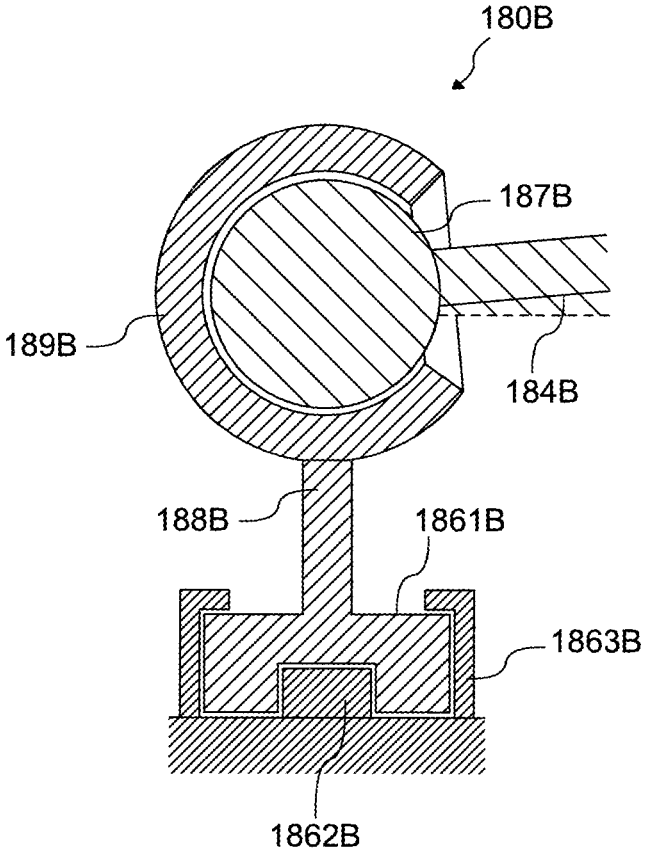
FIG. 11 is a view describing a structure of the connecting portion according to a third embodiment.

FIG. 11 is a view describing a structure of the connecting portion according to a third embodiment. FIG. 11 is a view of the connecting portion 180B seen from the side. A solid line shown in FIG. 11 indicates a case in which the key is at the rest position, and a broken line indicates a case in which the key is at the end position. The connecting portion 180B includes a key connecting member 184B, a rotation member 187B, a supporting member 189B, a pillar member 188B, and a rail member (base 1861B, rail 1862B, frame body 1863B).

The rotation member 187B is a spherical body in the present example. The key connecting member 184B is connected to the key 100. The supporting member 189B is a member that slidably covers the rotation member 187B, and is a spherical body having a hollow interior but opened in a movable range of the key connecting member 184B in the present example. The rotation member 187B can rotate in any direction in the interior of the supporting member 189B. The rotation range, however, is regulated by the range of opening of the supporting member 189B. The rotation mechanism including the rotation member 187B and the supporting member 189B provides a degree of freedom with respect to the rolling direction R of the key. Furthermore, the movement of the key by the pushing of the key is also enabled.

The base 1861B is slidably moved and is movable along the scale direction S by the rail 1862B and the frame body 1863B. The supporting member 189B is connected to the base 1861B by the pillar member 188B. Thus, the supporting member 189B is also movable along the scale direction S. The pillar member 188B is made from a flexible member. However, the pillar member does not need to be easily bent as much as the rod-like flexible member 185 in the first embodiment described above. In addition to the degree of freedom in the scale direction S of the key by the rail member, the degree of freedom in the yawing direction Y of the key is also provided by further including the flexibility of the pillar member 1886.

According to each of such configurations, the connecting portion 180B has the movement regulated in the vertical direction and the front and back direction, but has a degree of freedom with respect to the scale direction S, the rolling direction R and the yawing direction Y of the key.

Alternative Embodiment (1) The connecting portion 180 described above has two types of flexible members, the plate-like flexible member 181 and the rod-like flexible member 185, but may include only one of the flexible members. When only the plate-like flexible member 181 exists and the rod-like flexible member 185 that becomes a turning axis does not exist, for example, a member for supporting the key 100 at the turning axis merely needs to be provided to turnably connect the key 100 to the frame 500. In other words, the connecting portion 180, as a whole, merely needs to have a configuration of turnably connecting the key 100 to the frame 500 and having a degree of freedom in the rolling direction R and the yawing direction Y of the key 100. In this case, the connecting portion 180 may have the movement regulated in the vertical direction and the front and back direction.

(2) The key 100 is a structural body made of resin, but the visual impression thereof may be improved by attaching a wood member on a side surface at a portion (key main body portion) of the appearing portion PV of the key 100. In this case, the side key guide 153 is preferably arranged in a region other than the region where the wood member is attached, that is, the region where the resin member is exposed. In other words, the side frame guide 513 makes contact with the region of the resin member.

(3) The regulation of the movement in the front and back direction of the key 100 has been realized by the side key guide 153, but may be realized by other guides.

(4) The turning center of the black key 100*b* and the turning center of the white key 100*w* may be the same position with respect to the far side direction. In this case, the size of the connecting portions 180*b*, 180*w* in the scale direction S is to be defined so that the connecting portions 180*b*, 180*w* can be arranged adjacent to each other.

(5) In the embodiment described above, the key 100 has the movement in the scale direction S, the rolling direction R, and the yawing direction Y regulated, but only some movement may be regulated. For example, in the first embodiment, the movement in the scale direction S and the yawing direction Y may be regulated, and the movement in the rolling direction R may not be regulated. In this case, the connecting portion 180 merely needs to have a degree of freedom in the rolling direction R (may have degree of freedom in the scale direction S combining the deformation in the rolling direction R), and may not have a degree of freedom in the yawing direction Y.

REFERENCE SIGNS LIST

1 . . . keyboard apparatus
10 . . . keyboard assembly
70 . . . sound source device
80 . . . speaker

90 . . . housing
100 . . . key
100*w* . . . white key
100*b* . . . black key
120, 120*w*, 120*b* . . . hammer supporting portion
151, 151*w*, 151*b* . . . front end key guide
151*u* . . . upper key guide
151*d* . . . lower key guide
153, 153*w*, 153*b* . . . side key guide
1531, 1533 . . . protrusion
1535 . . . groove
180, 180A, 180B . . . connecting portion
181, 181*w*, 181*b* . . . plate-like flexible member
183, 183*w*, 183*b* . . . key side supporting portion
184B . . . key connecting member
185, 185*w*, 185*b* . . . rod-like flexible member
1861B . . . base
1862B . . . rail
1863B . . . frame body
187A, 187B . . . rotation member
188B . . . pillar member
189A, 189B . . . supporting member
189*u*A . . . upper member
189*d*A . . . lower member
200 . . . hammer assembly
210 . . . front end
220 . . . shaft supporting portion
230 . . . weight portion
300 . . . sensor
410 . . . lower stopper
430 . . . upper stopper
500 . . . frame
511 . . . front end frame guide
513 . . . side frame guide
520 . . . shaft
585, 585*w*, 585*b* . . . frame side supporting portion
590 . . . supporting column
710 . . . signal converting unit
730 . . . sound source unit
750 . . . output unit

What is claimed is:

1. A keyboard apparatus comprising:

a key;

a guide regulating a direction in which the key moves, the guide being arranged on a frame at three or more locations not lined in a straight line when seen along a scale direction of the key, and the guide slidably making contact with the key from both sides in the scale direction; and a connecting portion connecting the key to the frame at the back side of the key from the guide, the connecting portion including a rod-like flexible member.

2. The keyboard apparatus according to claim 1, wherein the key includes a wood member and a resin member; and the guide makes contact with a region formed with the resin member of the key.

3. The keyboard apparatus according to claim 1, wherein movement in a front and back direction of the key is further regulated at at least one point of a portion making contact with the key in the guide or at the connecting portion.

4. The keyboard apparatus according to claim 1, further comprising a hammer assembly making contact with the key at a lower side of the key at a position on a front side from a back end of a key main body portion, and applying a load to pushing of the key.

5. The keyboard apparatus according to claim 1, further comprising a sensor arranged on a lower side of the key at a position on a front side from a back end of a key main body portion to detect an operation with respect to the key.

6. The keyboard apparatus according to claim 5, further comprising a sound source unit configured to generate a sound waveform signal according to an output signal of the sensor.

7. A keyboard apparatus comprising:

a key;

a guide regulating a direction in which the key moves, the guide being arranged on a frame at three or more locations not lined in a straight line when seen along a scale direction of the key, and the guide slidably making contact with the key from both sides in the scale direction; and a connecting portion connecting the key to the frame at the back side of the key from the guide, the connecting portion including a plate-like flexible member, and a normal direction of the plate-like flexible member including a component in the scale direction.

8. The keyboard apparatus according to claim 7, wherein the key includes a wood member and a resin member; and the guide makes contact with a region formed with the resin member of the key.

9. The keyboard apparatus according to claim 7, wherein movement in a front and back direction of the key is further regulated at at least one point of a portion making contact with the key in the guide or at the connecting portion.

10. The keyboard apparatus according to claim 7, further comprising a hammer assembly making contact with the key at a lower side of the key at a position on a front side from a back end of a key main body portion, and applying a load to pushing of the key.

11. The keyboard apparatus according to claim 7, further comprising a sensor arranged on a lower side of the key at a position on a front side from a back end of a key main body portion to detect an operation with respect to the key.

12. The keyboard apparatus according to claim 11, further comprising a sound source unit configured to generate a sound waveform signal according to an output signal of the sensor.

13. A keyboard apparatus comprising:

a key;

a guide regulating a direction in which the key moves, the guide being arranged on a frame at three or more locations not lined in a straight line when seen along a scale direction of the key, and the guide slidably making contact with the key from both sides in the scale direction; and a connecting portion connecting the key to the frame at the back side of the key from the guide, the connecting portion including a rotation member and a supporting member with an upper member and a lower member that sandwich the rotating member from a vertical direction, the rotation member or the supporting member having a shape including a circular arc when a cross-section including the scale direction at a portion where the rotation member and the supporting member are brought into contact is seen.

14. The keyboard apparatus according to claim 13, wherein the key includes a wood member and a resin member; and the guide makes contact with a region formed with the resin member of the key.

15. The keyboard apparatus according to claim 13, wherein movement in a front and back direction of the key is further regulated at at least one point of a portion making contact with the key in the guide or at the connecting portion.

16. The keyboard apparatus according to claim 13, further comprising a hammer assembly making contact with the key at a lower side of the key at a position on a front side from a back end of a key main body portion, and applying a load to pushing of the key.

17. The keyboard apparatus according to claim 13, further comprising a sensor arranged on a lower side of the key at a position on a front side from a back end of a key main body portion to detect an operation with respect to the key.

18. The keyboard apparatus according to claim 17, further comprising a sound source unit configured to generate a sound waveform signal according to an output signal of the sensor.

* * * * *